US005385079A

United States Patent [19]

Cave

[11] Patent Number: 5,385,079

[45] Date of Patent: Jan. 31, 1995

[54] VORTICES-ACTIVATED MUZZLE STABILIZER FOR A GUN

[75] Inventor: Richard G. Cave, Wimborne, United Kingdom

[73] Assignee: Datestyle Limited, London, England

[21] Appl. No.: 119,179

[22] PCT Filed: Mar. 20, 1992

[86] PCT No.: PCT/GB92/00511

§ 371 Date: Sep. 20, 1993

§ 102(e) Date: Sep. 20, 1993

[87] PCT Pub. No.: WO92/16812

PCT Pub. Date: Oct. 1, 1992

[30] Foreign Application Priority Data

Mar. 22, 1991 [GB] United Kingdom ..... 9106153

[51] Int. Cl.[6] ..... F41A 21/34; F41A 21/36

[52] U.S. Cl. ..... 89/14.3

[58] Field of Search ..... 89/14.2, 14.3, 14.4

[56] References Cited

U.S. PATENT DOCUMENTS

| | | | |
|---|---|---|---|
| 1,429,619 | 9/1922 | Nelson | 89/14.3 |
| 2,953,972 | 9/1960 | Sorensen | 89/14.3 |
| 3,155,003 | 11/1964 | Ruth | 89/14.2 |
| 3,492,750 | 2/1970 | Ashbrook et al. | 89/14.3 |
| 3,698,747 | 10/1972 | Wing et al. | 89/14.3 |
| 4,643,073 | 2/1987 | Johnson | 89/14.3 |
| 4,879,942 | 11/1989 | Cave | 89/14.3 |
| 5,092,223 | 3/1992 | Hudson | 89/14.2 |

FOREIGN PATENT DOCUMENTS 525813 2/1954 Belgium .

*Primary Examiner*—David Brown

*Attorney, Agent, or Firm*—Iandiorio & Teska

[57] ABSTRACT

A vortices-activated muzzle stabilizer (2) for a gun, which muzzle stabiliser (2) comprises a cylindrical body (4) having a main vent slot (6) which defines a main gas deflection area and which deflects the gases in the form of gas vortices, a balancing slot (12) which extends at 90 degrees to the longitudinal axis of the body (4) and which is positioned opposite the main vent (6), a barrel connecting bore (14) for affording a connecting passage between the muzzle stabilizer (2) and the barrel of the and a gas exhaust aperture (20) which is positioned at a downstream end (22) of the body (4).

9 Claims, 4 Drawing Sheets

VORTICES-ACTIVATED MUZZLE STABILIZER FOR A GUN

This invention relates to a vortices-activated muzzle stabiliser for a gun.

Muzzle compensators for guns are well known. The muzzle compensators are used on many different types of guns and they tend to act to reduce recoil but they give little control on barrel movement. The known muzzle compensators deflect the gases, usually sideways, such that they only control muzzle movement in one direction.

It is an aim of the present invention to obviate or reduce the above mentioned problem.

Accordingly, this invention provides a vortices-activated muzzle stabilser for a gun, which muzzle stabiliser comprises a cylindrical body having:

(i) a single main vent slot which defines a main gas deflection area by extending inwardly at an angle of less than 40 degrees to the longitudinal axis of the body from a peripheral portion of the body to a central portion of the body, and which deflects the gases in the form of gas vortices;

(ii) a balancing slot which extends at 90 degrees to the longitudinal axis of the body and which is positioned opposite the main vent slot;

(iii) a barrel connecting bore for affording a connecting passage between the muzzle stabiliser and the barrel of the gun; and (iv) a gas exhaust aperture which is positioned at a downstream end of the body.

Unlike known muzzle compensators, the muzzle stabiliser of the present invention operates on gas vortices generated during the firing of the gun. The muzzle stabiliser enables the gas vortices to be deflected and directed as required to balance the muzzle. The muzzle stabiliser not only reduces recoil but is able to control the movement of the barrel of the gun in three directions. The muzzle stabiliser may be used on all types of guns. Thus, for example, the muzzle stabiliser may be used on rifles, hand guns and cannons, and the guns may be used for military or civilian purposes as required.

The main vent slot may extend inwardly at an angle of 15–35 degrees to the longitudinal axis of the body. Preferably, the main vent slot extends inwardly at an angle of 25 degrees to the longitudinal axis of the body.

The main vent slot may deflect the gas in the form of two vortices which extend away from each other at an angle of 45 degrees and which define between them a substantially solid wall of gas during firing of the gun.

The muzzle stabilser may include an insert positioned in the barrel connecting bore, the insert having a sloping end which extends inwardly at an angle of less than 90 degrees to the longitudinal axis of the body, the sloping end having a slot positioned adjacent the balancing slot so that the sloping end does not block the balancing slot, and the insert being such that it causes a low gas pressure between the insert and an inside wall of the body during use of the vortices-activated muzzle stabiliser.

The muzzle stabiliser may be such that it is able to be rotatably adjusted for right or left handed persons.

The balancing slot will usually be constructed to be proportional to the size of the barrel connecting bore and the size of the gas exhaust aperture.

If desired, the body may be provided with a gas brake device. The gas brake device may comprise a gas diverting aperture which extends completely through the gas brake device and at 90 degrees to the longitudinal axis of the body.

The body may be made in one piece. Alternatively, if desired, the body may be made in two or more parts.

The muzzle stabiliser may include a flash hider which operates to suppress flash consequent upon firing of the gun. Since the flash hider operates to break up the exhaust gases, care should be taken to ensure that the flash hider does not adversely affect the compensation. The flash hider may be any known and suitable type of flash hider.

The muzzle stabiliser may be one in which the body is made in two relatively rotatable parts which are rotateable from a first position in which the muzzle stabiliser operates in a muzzle stabilising mode to second position in which the muzzle stabiliser operates in a flash suppressing mode.

Embodiments of the invention will now be described solely by way of example and with reference to the accompanying drawings in which.

Figure 1:
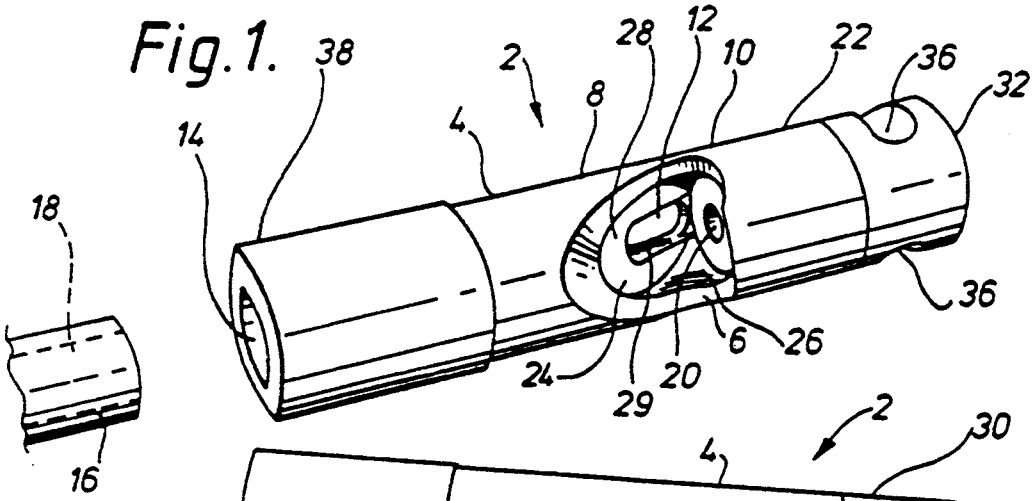
FIGS. 1 and 2 show a first muzzle stabiliser from different views.
Figure 2:
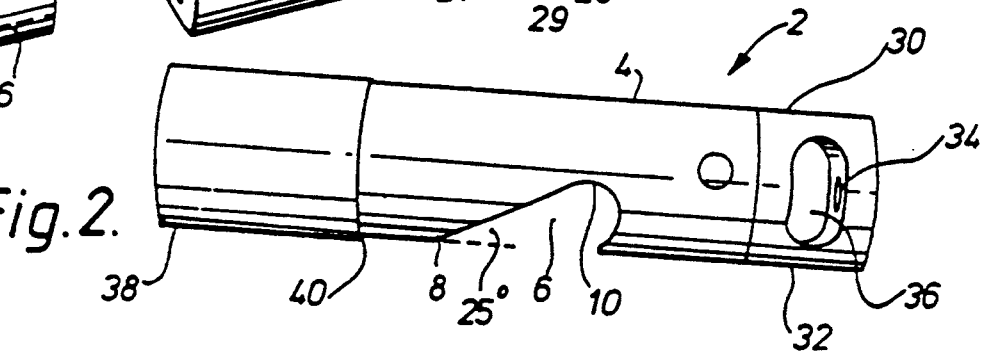

Referring to FIGS. 1 and 2, there is shown a muzzle stabiliser 2 for a gun. The muzzle stabiliser 2 comprises a cylindrical body 4.

The body 4 comprises a main vent slot 6 which defines a main gas deflection area. The main vent slot 6 extends inwardly at an angle to the longitudinal axis of the body 4 from a peripheral portion 8 of the body 4 to a central portion 10 of the body 4. As can be seen most clearly from FIG. 2, the central portion 10 is positioned inwardly for approximately half the diameter of the body 4. The main vent slot 6 is effective to deflect the gases in the form of gas vortices. More specifically, as the gun is fired, the generated gases pass along a bore 18 of the barrel 16 of the gun. The gas can then pass into the muzzle stabiliser 2 from where they are deflected as vortices through the main vent slot 6.

The muzzle stabiliser 2 also comprises a balancing slot 12 which is shown in FIG. 1. The balancing slot 12 extends at 90 degrees to the longitudinal axis of the body 4. As can be seen from FIG. 1, the balancing slot 12 is positioned opposite the main vent slot 6. Gases from the gun are also able to pass through the balancing slot 12. The gases passing through the balancing slot 12 act to prevent over compensation due to the action of the main vent slot 6.

The muzzle stabiliser 2 further comprises a barrel connecting bore 14 for affording a connecting passage between the muzzle stabiliser 2 and the barrel 16 of the gun. During firing of the gun, the gases pass along the bore 18 of the gun and then into the barrel connecting bore 14 of the muzzle stabiliser 2.

The muzzle stabiliser 2 still further comprises a gas exhaust aperture 20. The gas exhaust aperture 20 is positioned at a downstream end 22 of the body 4. The gases in the muzzle stabiliser 2 not dispersed through the main vent slot 6 and the balancing slot 12 pass through the gas exhaust aperture 20 and out through the muzzle stabiliser 2. Obviously, the fired bullet or bullets also pass out of the muzzle stabilisers 2 through the gas exhaust aperture 20.

As can be seen from FIG. 2, the main vent slot 6 extends at an angle of inclination of 25 degrees to the longitudinal axis of the body 4. This angle of inclination may be varied by plus or minus 10 degrees. On firing of the gun, the main vent slot 6 deflects the gases in the form of two vortices which extend away from each other at an angle of 45 degrees and which define between them a substantially solid wall of gas.

The body 4 includes an insert 24. The insert 24 is positioned in the barrel connecting bore 14, upstream of the gas exhaust aperture 20. The insert 24 is of such a shape relative to the body 4 that the insert 24 causes the formation of low pressure gas between the insert 24 and an inside wall 26 of the body 4. The insert 24 has a sloping end 28 and the gases tend to rotate off this sloping end 28. The sloping end 28 has a slot 29 which avoids the sloping end 28 blocking the balancing slot 12.

The end of the insert 24 remote from the sloping end 28 is threaded so that it is able to screw into the body 4 of the muzzle stabilser 2.

The muzzle stabiliser 2 shown in FIGS. 1 and 2 is rotateably adjustable for right or left handed persons. This may be effected by an adjustment device 30. The adjustment device 30 may act to lock the muzzle stabiliser 2 in its chosen position.

The muzzle stabiliser 2 is provided with a gas brake device 32. The gas brake device 32 can be screwed or otherwise, secured to the body 4. The gas brake device 32 has a central gas exhaust aperture, 34 through which the fired bullets and non-deflected gases pass. The gas brake device 32 has a gas diverting aperture 36 which extends completely through the gas brake device 34 at 90 degrees to the longitudinal axis of the body 4. The body 4 is preferably made in one piece. If desired, the body 4 may be made in two parts which screw together To form a join 40. The insert 24 will usually be separately made. The gas brake device 32 may be separately made or it may be formed as an integral part of the body 4.

Figure 3:
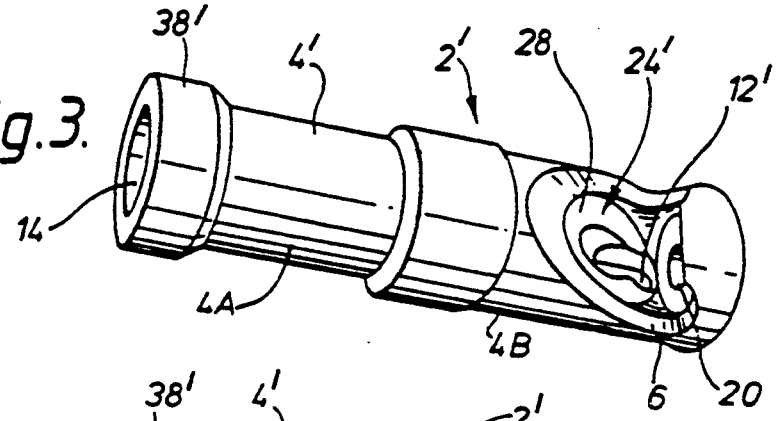
FIGS. 3 and 4 show a second muzzle stabiliser from different views.
Figure 4:
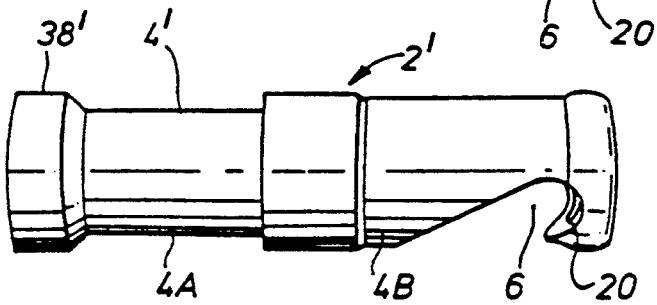

Referring now to FIGS. 3 and 4, similar parts as in FIGS. 1 and 2 have been given similar reference numerals for each of comparison and understanding. In FIGS. 3 and 4, it will be seen that the gas brake device 32 has been omitted. Also, in FIGS. 3 and 4, the end 38' of the muzzle stabiliser 2' is different from the end shown in FIGS. 1 and 2. As shown in FIGS. 1 and 2, the end 38 of the muzzle stabiliser 2 is that end which connects to the barrel 16 of the gun. Generally, the end 38 of the .muzzle stabiliser 2 can be screwed to the end of the barrel 16, pushed over the end of the barrel 16, or otherwise connected as may be suitable and appropriate to the end of the barrel 16.

As can also be seen from FIGS. 3 and 4, the outside shape of the body 4' is different to that shown in FIGS. 1 and 2.

Figure 5:
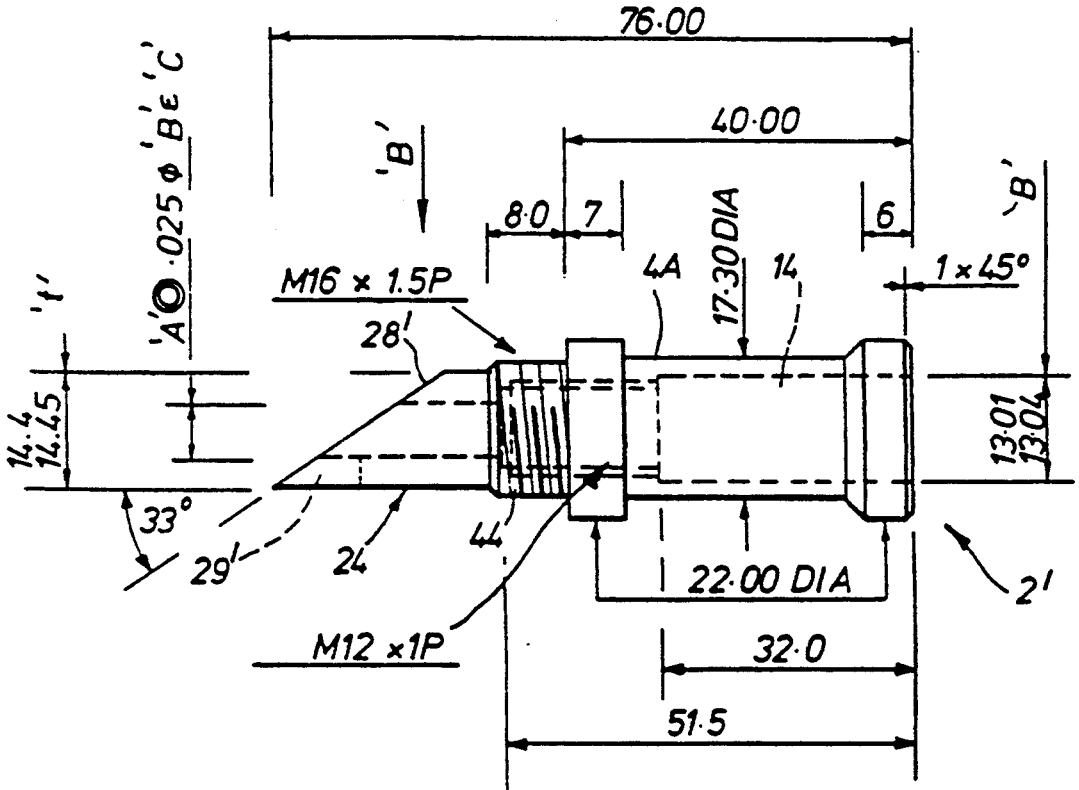
FIG. 5 is a side view of part of the muzzle stabiliser shown in FIGS. 3 and 4 and shows various measurements.
Figure 6:
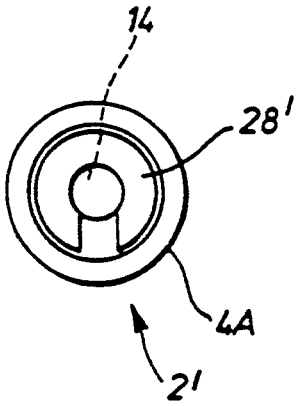
FIG. 6 is an end view of the part of the muzzle stabiliser shown in FIG. 5 looking from left to right.
Figure 7:
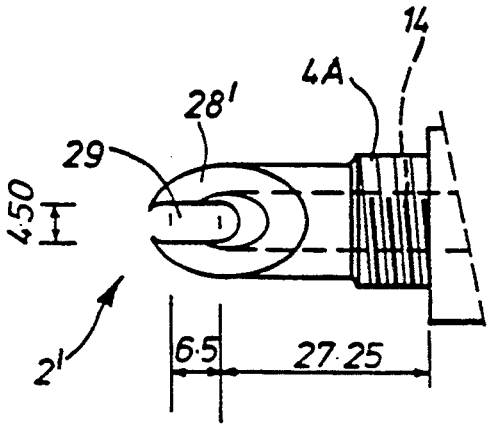
FIG. 7 is a partial top plan view on arrow B of the part of the muzzle stabiliser shown in FIG. 5.

Referring now to FIGS. 5, 6 and 7, there are shown different views of a first part 4A of the body 4' of the muzzle stabiliser 2' shown in FIGS. 3 and 4. Various size dimensions and angles are shown in FIGS. 5, 6 and 7, the size dimensions being in millimeters.

Figure 8:
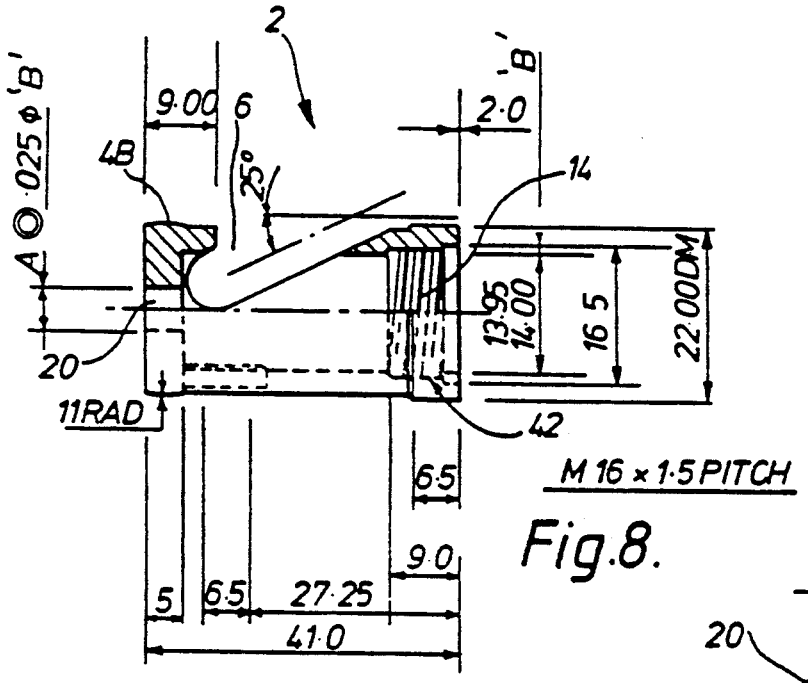
FIG. 8 is a side view, partially in section, of another part of the muzzle Stabiliser shown in FIGS. 3 and 4 and shows various measurements.
Figure 9:
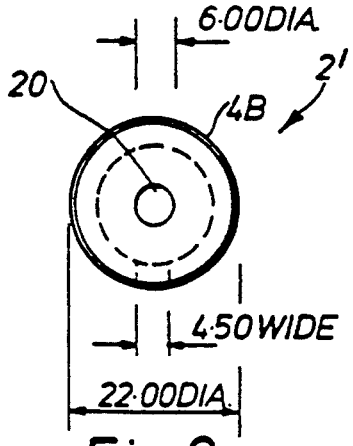
FIG. 9 is an end view of the part of the muzzle stabiliser shown in FIG. 8, looking from left to right.

FIG. 8 is a longitudinal view, partially in section, of a second part 4B of the muzzle stabiliser 2' shown in FIGS. 3 and 4. FIG. 9 is an end view of the muzzle stabiliser 2' shown in FIG. 8. In FIGS. 8 and 9, various sized dimensions and angles have again been shown, the size dimensions being in millimeters. The second part 4B has a screw threaded recess 42 for receiving a screw threaded portion 44 of the part 4A, thereby enabling the parts 4A and 4B to be screwed together.

Figure 10:
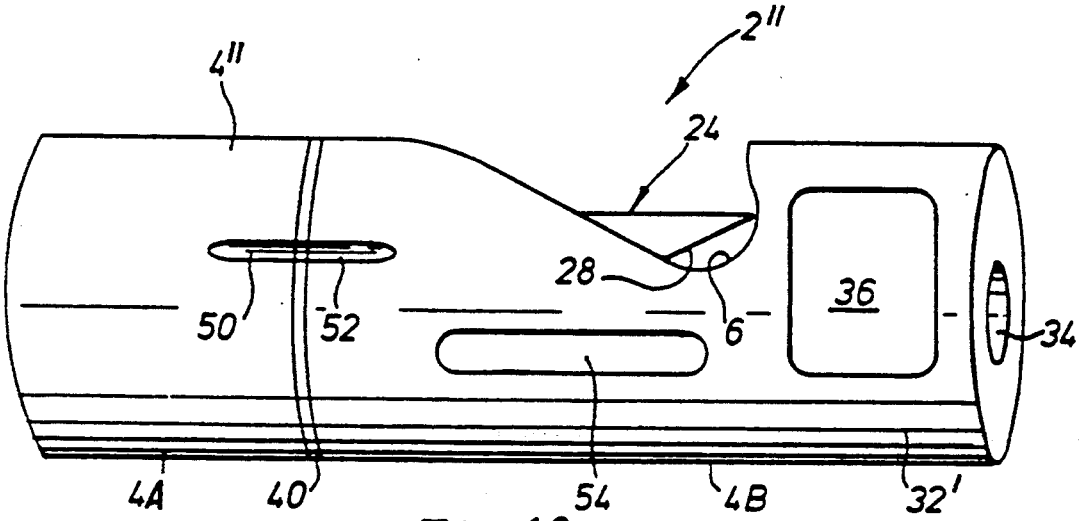
FIG. 10 shows a third muzzle stabiliser.
Figure 11:
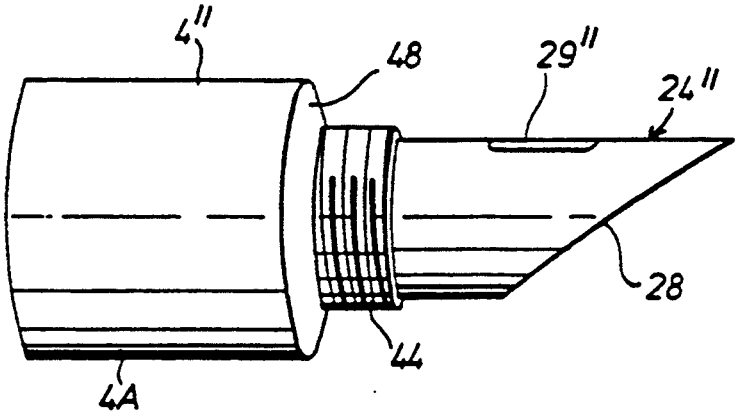
FIGS. 11 and 12 show two parts of the third muzzle stabiliser shown in FIG. 10.
Figure 12:
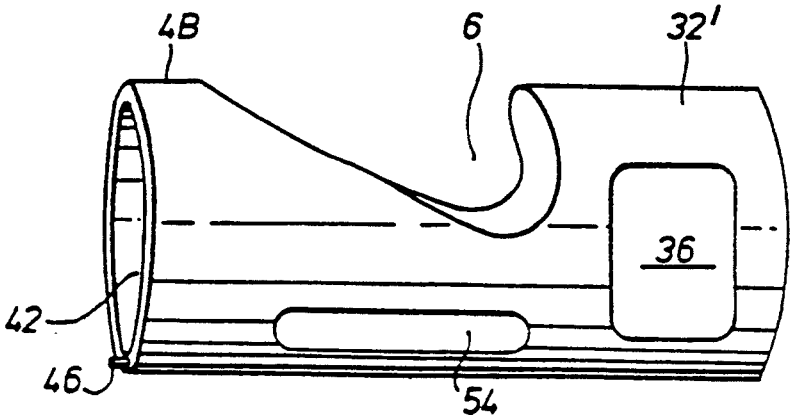

Referring now to FIGS. 10, 11 and 12 there is shown a third muzzle stabiliser. Similar parts as in previous Figures have been given the same reference numerals for ease of comparison and understanding. The first and second parts 4A, 4B of the body 4" screw together as shown and they are made to be rotateable through 180 degrees. Thus, from a comparison of FIGS. 1 and 3 on the one hand and FIG. 10 on the other hand, it will be seen that the insert 24" has been rotated through 180 degrees as compared with the position of the insert 24 shown in FIGS. 1 and the insert 24' shown in FIG. 3. In the position of the insert 24" shown in FIG. 10, the muzzle stabiliser 2 acts in a different mode of operation to provide flash suppression. Thus the muzzle stabiliser 2" in the position shown in FIG. 10 acts as a flash hider or a flash suppressor.

Rotation of the muzzle stabiliser 2" from its flash suppressor mode of operation as shown in FIG. 10 to its muzzle stabilizing mode of operation in which the position of the insert 24" is rotated through 180 degrees and is then the same as shown in FIGS. 1 and 3, is effected by relative rotation of the parts 4A and 4B using the screw threaded portion 44 and the screw threaded recess 42. As can be seen from FIG. 12, a locking pin 46 is provided. This locking pin 46 goes in one of a pair of opposed apertures (not shown) in the end face 48 of the part 4A. When the pin 46 is in its aperture 46, relative rotation of the parts 4A and 4B is prevented.

The part 4A is provided with a pair of aligning grooves 50, the aligning grooves 50 being on opposite sides of the part 4A and only one aligning groove being shown. Similarly, the part 4B is provided with a pair of aligning grooves 52. When the aligning grooves 50, 52 line up as shown in FIG. 10, then the parts 4A, 4B have been relatively rotated to the required extent to enable the locking pin 46 to locate in an appropriate one of the apertures in the end face 48.

As can be seen from FIG. 10, the gas brake 32 is formed as an integral part of the part 4B. Thus, when a gas braking effect is required of the muzzle stabiliser 2, then the part 4B can be produced with the integral gas brake device 32'. If a gas braking effect is not required, then the part 4B can be produced without the gas brake device 32'. Generally, the gas brake device 32' would be used on higher calibre guns.

As shown in FIG. 11, the slot 29" is a closed slot, rather than being an open slot as shown in FIG. 1.

Referring to FIGS. 10 and 12, the part 4B of the body 4" is provided with a series of apertures 54. The apertures 54 are shown as slots and there are in fact six of the apertures employed in the muzzle stabiliser 2 shown in FIGS. 10 to 12. The size, length and number of the apertures 54 may be varied for different lengths of barrels of different guns.

Figure 13:
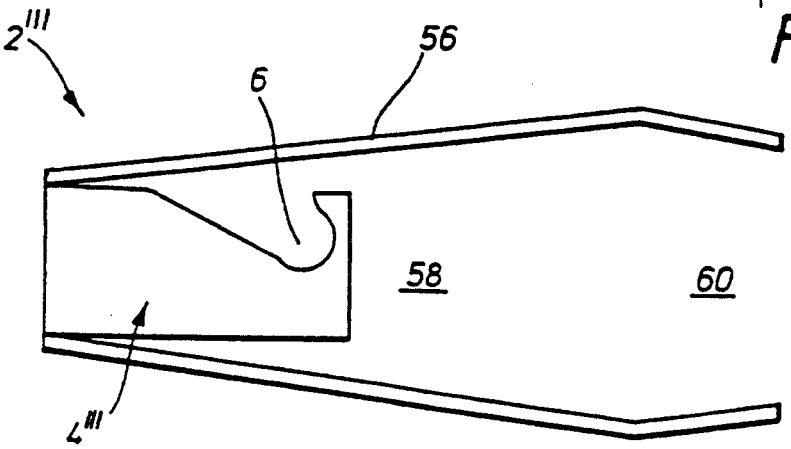
FIG. 13 shows a fourth muzzle stabiliser provided with a booster device.

Referring now to FIG. 13, there is shown a muzzle stabiliser 2''' which is provided with a booster device 56. The booster device 56 is generally conically shaped as shown. The booster device 56 can be secured to the body 4''' in any suitable and appropriate manner. The booster device 56 allows propellant gas to expand in zone 58 before being compressed in zone 60 to increase recoil. The size, shape and general construction of zone 60 can be varied for different lengths of barrels of different guns. The booster device 56 operates such that it first reduces recoil, then stabilises, then acts in a boost mode to increase recoil to operate self-loading mechanisms on guns fitted with the muzzle stabiliser 2'''. Thus muzzle stabilisers 2''' provided with the booster device 56 will usually only be fitted on guns where the barrel is propelled rearwardly in order to operate a self-loading mechanism.

It is to be appreciated that the embodiments of the invention described above with reference to the accompanying drawings have been given by way of example only and that modifications may be effected. Thus, for example, the muzzle stabilisers shown in FIGS. 1 to 9 may be provided with a flash hider if desired.

It is claimed:

1. A vortices-activated muzzle stabiliser for a gun, which muzzle stabiliser comprises a cylindrical body having:

(i) a single main vet: slot, which defines a main gas deflection area by extending inwardly at an angle of less than 90 degrees to the longitudinal axis of the body from a peripheral portion of the body to a central portion of the body, and which deflects the gases in the form of gas vortices;

(ii) a balancing slot which extends at 90 degrees to the longitudinal axis of the body and which is positioned opposite the main vent slot;

(iii) a barrel connecting bore for affording a connecting passage between the muzzle stabiliser and the barrel of the gun; and (iv) a gas exhaust aperture which is positioned at a downstream end of the body.

2. A vortices-activated muzzle stabiliser according to claim 1 and including an insert positioned in the barrel connecting bore, the insert having a sloping end which extends inwardly at an angle of less than 90 degrees to the longitudinal axis of the body, the sloping end having a slot positioned adjacent the balancing slot so that the sloping end does not block the balancing slot, and the insert being such that it causes a low gas pressure between the insert and an inside wall of the body during use of the vortices-activated muzzle stabiliser.

3. A vortices-activated muzzle stabiliser according to claim 1 and which is rotatably adjustable for right and left handed persons.

4. A vortices-activated muzzle stabiliser according to claim 1 and including a flash hider.

5. A vortices-activated muzzle stabiliser according to claim 1 in which the body is made in two relatively rotatable parts which are rotatable from a first position in which the muzzle stabiliser operates in a muzzle stabilising mode to a second position in which one muzzle stabiliser operates in a flash suppressing mode.

6. A vortices-activated muzzle stabiliser according to claim 1 in which the main vent slot extends inwardly at an angle of 15–35 degrees to the longitudinal axis of the body.

7. A vortices-activated muzzle stabiliser according to claim 6 in which the main vent slot extends inwardly at an angle of 25 degrees to the longitudinal axis of the body.

8. A vortices-activated muzzle stabiliser according to claim 1 and including a gas brake device.

9. A vortices-activated muzzle stabiliser according to claim 8 in which the gas brake device comprises a gas diverting aperture which extends completely through the gas brake device and at 90 degrees to the longitudinal axis of the body.

* * * * *